US010018012B2

(12) United States Patent
Boyd

(10) Patent No.: US 10,018,012 B2
(45) Date of Patent: Jul. 10, 2018

(54) ROTATING FLOW CONTROL DEVICE FOR WELLBORE FLUID CONTROL DEVICE

(75) Inventor: Michael Boyd, Nisku (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 717 days.

(21) Appl. No.: 14/344,482

(22) PCT Filed: Sep. 14, 2012

(86) PCT No.: PCT/CA2012/000851
§ 371 (c)(1),
(2), (4) Date: Sep. 5, 2014

(87) PCT Pub. No.: WO2013/037049
PCT Pub. Date: Mar. 21, 2013

(65) Prior Publication Data

US 2015/0021045 A1 Jan. 22, 2015

Related U.S. Application Data

(60) Provisional application No. 61/534,618, filed on Sep. 14, 2011.

(51) Int. Cl.
*E21B 34/02* (2006.01)
*E21B 33/08* (2006.01)
*E21B 33/06* (2006.01)

(52) U.S. Cl.
CPC ..... *E21B 34/02* (2013.01); *E21B 33/06* (2013.01); *E21B 33/085* (2013.01)

(58) Field of Classification Search
CPC ..... E21B 33/085; E21B 33/08; E21B 33/02; E21B 33/06
See application file for complete search history.

(56) References Cited

U.S. PATENT DOCUMENTS 4,143,881 A 3/1979 Bunting
4,383,577 A * 5/1983 Pruitt ..... E21B 33/085 166/95.1

(Continued)

FOREIGN PATENT DOCUMENTS

CA 2801788 12/2011
CA 2751179 2/2012

(Continued)

OTHER PUBLICATIONS

FEA Consulting; Getting a Grip on Oil Well Pressure with Design Space; Ohio CAE; www.ohiocae.com; pp. 1-4.

(Continued)

*Primary Examiner* — D. Andrews
*Assistant Examiner* — Manuel C Portocarrero
(74) *Attorney, Agent, or Firm* — Smith IP Services, P.C.

(57) ABSTRACT

The invention relates to a rotating flow control device and methods of using the same for controlling wellbore fluids at the head of a riser diverter for use in offshore drilling operations or the head of a blowout preventer stacks annular for conventional land-based drilling operations. The rotating flow control device comprises a stationary housing to be mounted on the head of a riser diverter or the blowout preventer stacks annular, an inner tubular shaft that permits the passage of a tubular, sealed bearing elements for supporting and permitting the axial rotation of the inner tubular shaft, and an elastomeric stripper element attached to the inner tubular shaft for sealing around the tubular.

19 Claims, 3 Drawing Sheets

(56) References Cited

U.S. PATENT DOCUMENTS

| | | | | |
|---|---|---|---|---|
| 4,406,333 | A | 9/1983 | Adams | |
| 4,754,820 | A | 7/1988 | Watts et al. | |
| 4,832,126 | A | 5/1989 | Roche | |
| 5,305,839 | A | 4/1994 | Kalsi et al. | |
| 5,662,181 | A * | 9/1997 | Williams | E21B 33/085 166/84.3 |
| 6,129,152 | A | 10/2000 | Hosie et al. | |
| 6,244,359 | B1 | 6/2001 | Bridges et al. | |
| 6,443,240 | B1 | 9/2002 | Scott | |
| 6,470,975 | B1 | 10/2002 | Bourgoyne et al. | |
| 2003/0106712 | A1 | 6/2003 | Bourgoyne et al. | |
| 2006/0102387 | A1 | 5/2006 | Bourgoyne et al. | |
| 2006/0108119 | A1 * | 5/2006 | Bailey | E21B 33/085 166/341 |
| 2007/0163784 | A1 * | 7/2007 | Bailey | E21B 33/085 166/379 |
| 2009/0161997 | A1 | 6/2009 | Beauchamp et al. | |
| 2010/0175882 | A1 | 7/2010 | Bailey et al. | |
| 2011/0024195 | A1 * | 2/2011 | Hoyer | E21B 21/00 175/65 |
| 2012/0055677 | A1 | 3/2012 | Boyd | |

FOREIGN PATENT DOCUMENTS

| | | |
|---|---|---|
| EP | 1659260 | 5/2006 |
| WO | 9949173 | 9/1999 |
| WO | 0179654 | 10/2001 |
| WO | 2011153621 | 12/2011 |
| WO | 2013006963 | 1/2013 |
| WO | 2013037049 | 3/2013 |

OTHER PUBLICATIONS

Hannegan, D.; Rotating Control Heads the When and Why; Journal of Canadian Petroleum Technology; pp. 6-8.

Strata Energy Services Inc.; RFD Series: Rotating Flow Diverters; www.strataenergy.net; 4 pages.

* cited by examiner

ROTATING FLOW CONTROL DEVICE FOR WELLBORE FLUID CONTROL DEVICE

FIELD OF THE INVENTION

The present invention is directed to a rotating flow control device ("RFCD"), and more particularly to a RFCD for use on the riser diverter of an offshore oil and gas drilling assembly, or for use on a blowout preventer stacks annular of a land-based drilling assembly.

BACKGROUND OF THE INVENTION

During both offshore and land-based oil and gas drilling operations, the controlled containment and diversion of wellbore fluids and gas returns at the wellhead assembly presents a significant challenge. Gases dissolved in the wellbore fluid may rapidly decompress and expand while ascending the wellbore. Upon reaching the wellhead assembly, the wellbore gases may produce a shock known in industry as a "kick". Flow surges from the hydrocarbon producing formation can also result in shock waves in the wellbore fluid and kicks at the wellhead assembly. Kicks can be anticipated by detecting gas entry into the wellbore and significant changes in the wellbore fluid flow rate. Even if anticipated, however, kicks may subject the wellhead assembly to extreme and sudden pressure increases that can damage rig equipment or result in spillage and venting of wellbore fluids and gases. These undesirable effects can threaten the safety of rig operators and contaminate the environment.

In offshore drilling operations, the wellbore fluids are conveyed from the seafloor to a wellhead assembly on a floating drill ship or a drilling platform within a riser, the riser comprising, a conduit formed by lengths of pipe attached by flanged connections. Typically, a riser diverter is positioned at the head of the riser in series with a blowout preventer. The riser diverter has outlet and vent lines to direct wellbore fluid and gas returns away from the well head and the drilling platform. The blowout preventer has hydraulically and remotely actuated valves. In the event that the drilling crew loses pressure control over the wellbore fluid, the valves of the blowout preventer are actuated to close and halt the flow of wellbore fluid in the riser.

In conventional land-based oil and gas drilling operations, the wellbore fluids are conveyed from the wellbore to the wellhead assembly on the surface within a casing string. A top stack having a blowout preventer may be positioned at the top of the wellhead assembly. The blowout preventer may be of the ram type having gate-like or valve-like elements or the annular type having elastomeric sealing elements, which are mechanically actuated to constrict or close off the flow of wellbore fluid in the casing string.

Although these conventional wellbore fluid control devices provide some protection against kicks, it would be advantageous to have an additional pressure barrier between the wellbore fluids and the external environment for use in both off-shore and land based drilling operations. It would also be advantageous if such secondary pressure barrier could be relatively simple and easily installed on a conventional riser diverter assembly or on a blowout preventer stacks annular.

SUMMARY OF THE INVENTION

In one aspect, the present invention provides a rotating flow control device for installation on the head of a wellbore fluid control device, the wellbore fluid control device having a central bore for the passage of tubulars and wellbore fluid therethrough, said rotating flow control device comprising:

(a) a stationary housing being adapted to form a fluid-tight attachment to the head of the wellbore fluid control device and defining a central bore, the stationary housing being attached to the head of the wellbore fluid control device such that the central bores of the wellbore fluid control device and the stationary housing are axially aligned;

(b) a sealed bearing assembly comprising:

(i) an outer housing secured in a fluid-tight manner to the stationary housing, the outer housing defining a central bore, the outer housing being attached to the stationary housing such that the central bores of the stationary housing and the outer housing are axially aligned such that tubulars may pass through the rotating flow control device and into the wellbore fluid control device;

(ii) an inner tubular shaft disposed within the central bore of the outer housing to define an annular space between the inner tubular shaft and the outer housing, said inner tubular shaft being sized to permit the passage of tubulars therethrough;

(iii) bearing elements for radially and axially supporting the inner tubular shaft and permitting axial rotation of the inner tubular shaft within the outer housing, said bearing elements being disposed in the annular space;

(iv) a seal for sealing the bearing elements from wellbore fluids, said seal disposed in the annular space; and (c) an elastomeric stripper element for sealing around tubulars, said elastomeric stripper element being attached to the inner tubular shaft.

In one embodiment, the rotating flow control device as described above has a stationary housing comprising a flange connection for fluid tight connection to the head of the wellbore fluid control device. The flange connection may be releasably attached to the head of the wellbore fluid control device.

In one embodiment, the rotating flow control device as described above further comprises a clamp for releasably securing the outer housing to the stationary housing. The clamp may be a lockable continuous ring type or split-ring type clamp, which may be manually actuated or hydraulically actuated.

In another aspect, the present invention provides a method of creating a pressure barrier between a wellbore and an external environment, the method comprising mounting the rotating flow control device as described above on the head of a wellbore fluid control device. The wellbore fluid control device may be a riser diverter or a blowout preventer stacks annular.

In another aspect, the present invention provides a rotating flow control device for installation on the head of a wellbore fluid control device, the wellbore fluid control device having a central bore for the passage of tubulars therethrough, said rotating flow control device comprising:

(a) an outer housing being adapted to form a fluid-tight attachment to the head of the wellbore fluid control device and defining a central bore for permitting the passage of tubulars therethrough, the outer housing being attached to the head of the wellbore fluid control device such that the central bores of the wellbore fluid control device and the rotating flow control device are axially aligned;

(b) an inner tubular shaft size to permit the passage of tubulars therethrough, said inner tubular shaft disposed within the bore of the outer housing to define an annular space between the inner tubular shaft and the outer housing;

(c) bearing elements for radially and axially supporting the inner tubular shaft and permitting axial rotation of the inner tubulars shaft within the outer housing, said bearing elements being disposed in the annular space;

(d) a seal for sealing the bearing elements from wellbore fluids, said seal disposed in the annular space; and (e) an elastomeric stripper element for sealing around the tubulars, said elastomeric stripper element attached to the inner tubular shaft.

In one embodiment, the rotating flow control device as described above has an outer housing comprising a flange connection for fluid tight connection to the head of the wellbore fluid control device. The flange connection may be releasably attached to the head of the wellbore fluid control device.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The invention relates to a rotating flow control device ("RFCD"), and in particular to a RFCD that is adapted to be mounted on a riser diverter or on a blowout preventer stacks annular. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

As used herein, the term "wellbore fluid control device" means a riser diverter or a blowout preventer stack annular.

As used herein, the term "head" in relation to a wellbore fluid control device means the terminal outlet of the wellbore fluid control device, and without limiting the generality of the foregoing, includes the top cap of a riser diverter and the top of a blowout preventer stack annular.

As used herein, the term "wellbore fluid" refers to any flowable mixture of fluids, gases, or solids, and without limiting the generality of the foregoing, includes mixtures of drilling mud, cuttings, liquid hydrocarbons and gases.

Figure 1:
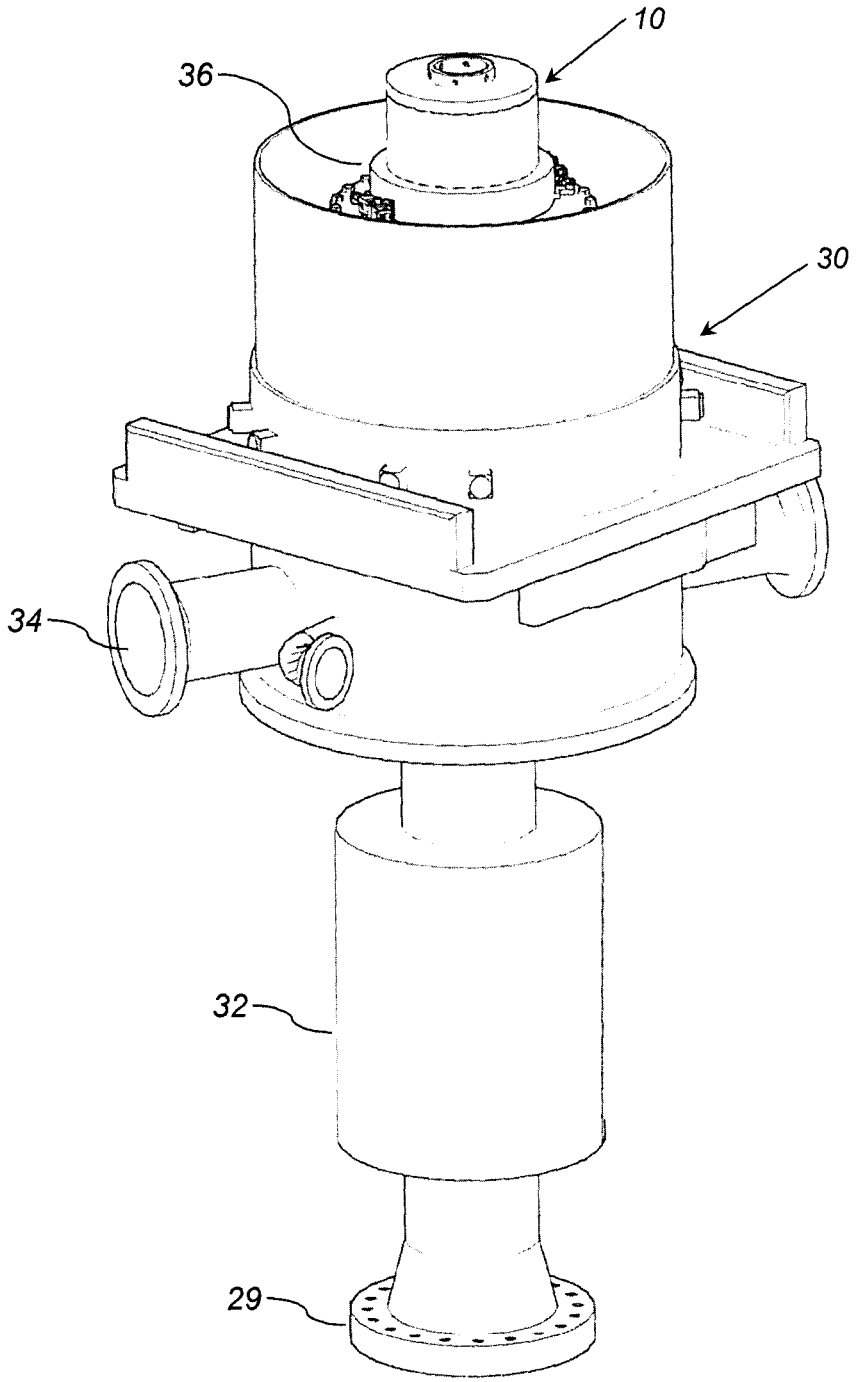
FIG. 1 is a diagrammatic depiction in elevation of one embodiment of the RFCD of the present invention mounted on a riser diverter.
Figure 2:
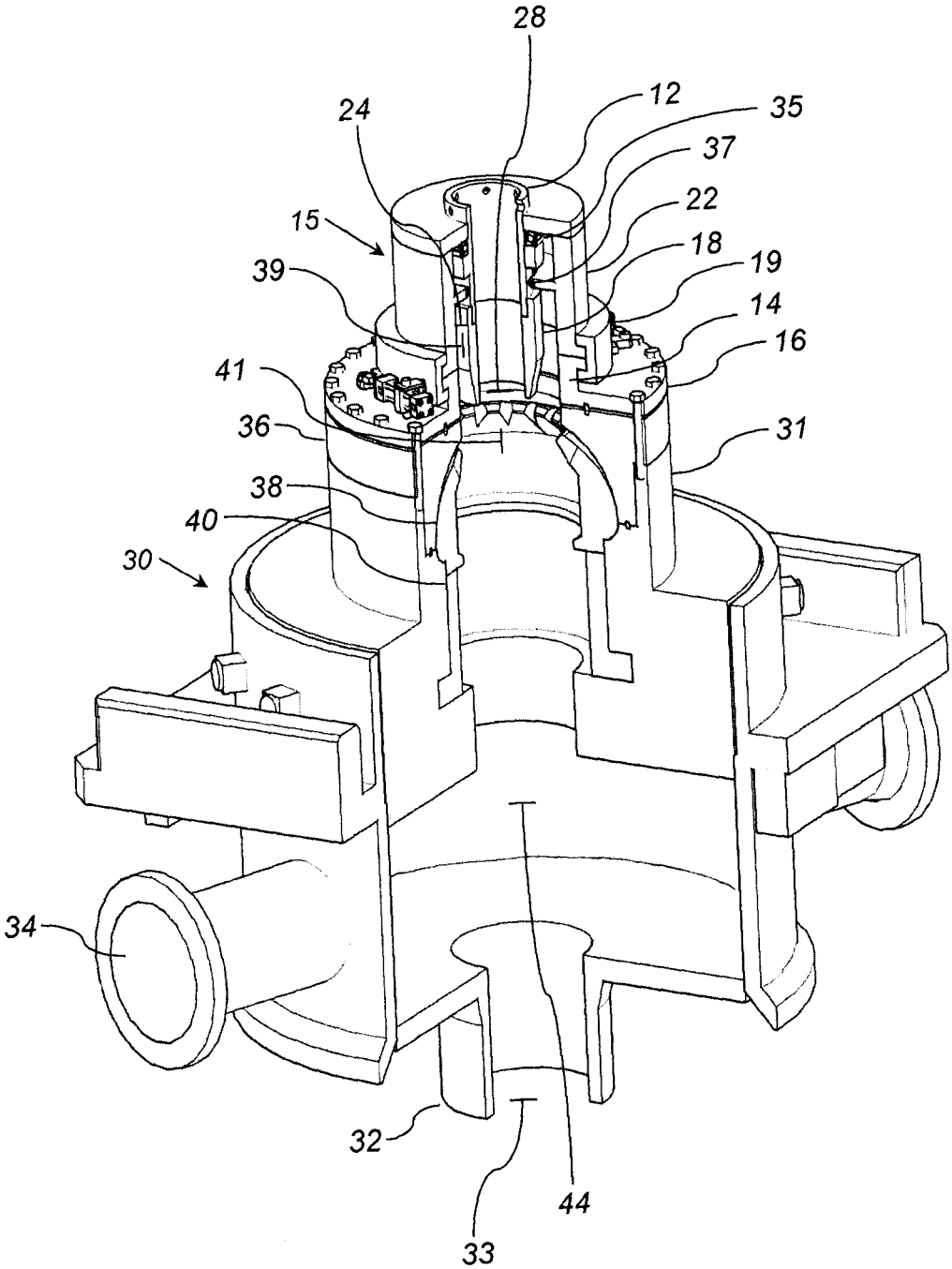
FIG. 2 is a cross sectional side view of one embodiment of the RFCD of the present invention mounted on a riser diverter.

FIGS. 1 and 2 depict an embodiment of the RFCD (10) of the present invention installed on an example of a diverter (30). Referring to FIG. 2, the diverter (30) comprises a housing (31), attached at its lower end to a slip joint (32), attached at its top end to a bolted-on cap (36), and containing an annular elastomeric stripper element (38). The slip joint (32) may be in turn connected to the top of a riser string via a flanged connection (29) as shown in FIG. 1. The diverter (30) defines a contiguous fluid passage extending from a bottom opening (33), through an intermediate central bore (44) and a narrower tubular portion (40), to a top opening (41). The central bore (44) is also in fluid communication with at least one radially extending port (34). As shown in FIG. 2, there may be a plurality of ports (34). The bottom opening (33), tubular portion (44), annular stripper element (38), and top opening (41) are axially aligned so that a drill string (not shown) may extend through them while leaving an annular space between the drill string and the inner walls of the annular stripper element (38).

Referring to FIG. 2, one embodiment of the RFCD (10) of the present invention comprises a stationary housing (14), a sealed bearing assembly (15), an elastomeric stripper element (18), and a clamp (19).

The stationary housing (14) defines a central bore (28) for permitting the passage of tubular members such as drill string (not shown). As can be seen in FIG. 2, when the RFCD (10) is operatively mounted on the diverter (30), the central bore (28) of the stationary housing (14) of the RFCD (10) and the central bore (44) of the diverter (30) are aligned to form a contiguous passage way for the drill string. The stationary housing (14) has a flange connection (16) for connecting the stationary housing (14) in a fluid-tight manner with the cap (36) of the diverter (30). In one embodiment shown in FIG. 2, the flange connection (16) is bolted to the cap (36). In other embodiments not shown, the flange connection (16) and the cap (36) are integrally machine-formed such that the flange connection (16) effectively substitutes for the cap (36). With the stationary housing (14) connected to the diverter in this manner, the bearing assembly (15) may be in certain embodiments (as described below) be quickly and efficiently installed on or removed from the stationary housing (14) as needed. In any embodiment, the flanged connection (16) can be custom-sized to match differing types and sizes of caps (36). In this manner, it is relatively straight forward to retrofit a conventional diverter (30) with the RFCD (10) of the present invention.

The sealed bearing assembly (15) comprises an outer housing (22), an inner tubular shaft (12), bearing elements (35), and a lower seal (37). The outer housing defines a central bore (39). When the outer housing (22) is mounted on the stationary housing (14) the central bore (28) of the stationary housing (14) and the central bore (39) of the outer housing (22) are aligned forming a continuous passage.

The inner tubular shaft (12) is disposed within the central bore (39) of the outer housing (22) to define an annular space (24) between the inner tubular shaft (12) and the outer housing (22). The inner tubular shaft (12) is axially aligned with the central bore (39) of the outer housing (22) such that it permits the passage of tubular members such as a drill string (not shown). The inner tubular shaft (12) is sized to permit the passage of tubular, such as drill string, therethrough.

The bearing elements (35) are disposed in the annular space (24). The bearing elements (35) radially and axially support the inner tubular shaft (12). As well, the bearing elements (35) permit the tubular shaft (12) to axially rotate within the central bore (39) of the outer housing (22).

The lower seal (37) is disposed in the annular space (24). The lower seal (37) isolates the bearing elements (35) from exposure to the wellbore fluids. In embodiments, the resulting sealed chamber containing the bearing elements (35) may be filled with a lubricating fluid to facilitate the rotation of the inner tubular shaft (12) within the outer housing (22). Any suitable seal as may be employed by one skilled in the art may be used for the lower seal (37) with the present invention. The bearing elements (35) may comprise any suitable type used for like purposes by those skilled in the art, and may be arranged in any manner within the annular space (24) that provides appropriate axial and radial support to the inner tubular shaft (12). In embodiment, the bearing elements (35) comprise a plurality of spring compressed bearings.

The elastomeric stripper element (18) is attached to the inner tubular shaft (12). The elastomeric stripper element seals around the tubular, thereby creating a fluid tight connection between the inner tubular shaft (12) and the tubular. In this manner, the tubular shaft (12) and the tubular rotate in unison. The elastomeric stripper element (18) may be manufactured from any suitable material including rubber. As shown in FIG. 1, in one embodiment, the elastomeric stripper element (18) is essentially cone shaped being securably attached at the wider end to the inner tubular shaft (12) by means of complimentary inserts. The narrower end of the stripper element (18) has an inner diameter that is less than the tubulars, such as drill string, being passed through the inner tubular shaft (12) resulting in a stretch fit. Pressure exerted on the cone shaped elastomeric stripper element (18) by fluids and gases from the wellbore below acts to further seal the stripper element (18) onto the tubular. The foregoing description of one embodiment of the stripper element is not intended to be limiting and one skilled in the art will recognize that any suitable stripper element commonly used in the industry may be employed with the present invention.

In one embodiment as shown in FIG. 2, a removable clamp (19) secures the bearing assembly (15) via the outer housing (22) to the stationary housing (14) in a fluid-tight manner. The clamp (19) may comprise a rotatable clamp, such as a continuous ring type clamp or a split-ring type clamp. The clamp (19) may be tightened manually or remotely by hydraulic or pneumatic means and may be secured in a closed position by means of locking tabs or pins.

In other embodiments not shown, the outer housing (22) and the stationary housing (14) may be secured in a fluid tight manner by any suitable method of integral construction. The outer housing (22) and the stationary housing may be constructed from any suitable material including, without limit, 41/30 alloy steel. In one embodiment not depicted in the figures, the outer housing (22) and the stationary housing (14) may be combined such that there is a single continuous housing rather than two discrete housings that are releasably connected. The advantage of having two discrete housings that are releasably connected is that an operator may engage in drilling operations with just the stationary housing (14) mounted on the diverter (30) or stack's annular (42) as the case may be, with the option of then mounting the outer housing (22) and associated elements in the event that unpredictable wellbore conditions are experienced.

In operation, the wellbore fluid flows upward from the wellbore into the diverter (30). During normal operations, the upward pressure of the wellbore fluid is relatively low and the influence of gravity will cause the wellbore fluid to flow through ports (34) so that the wellbore fluid can be safely diverted and treated, stored or disposed of. In the event of a detected kick, the stripper element (38) of the diverter (30) may be hydraulically actuated upwards and pressed against the curved underside of the cap (36), causing the annular stripper element (38) to constrict and seal against the drill string (not shown), thereby preventing the upward flow of the wellbore fluid. However, it is conceivable that the annular stripper element (38) might fail to adequately prevent the upward flow of the wellbore fluid if, for example, damage to the stripper element (38) compromises its sealing properties, the actuating mechanism malfunctions or fails to respond quickly enough to the kick, or the kick exceeds the pressure limits of the stripper element (38). It is also foreseeable that the stripper element (38) may not be actuated in the event of an undetected kick. In the absence of the RFCD (10), the wellbore fluid would spill or vent through the top opening (41) of the cap (36). In contrast, in the presence of the RFCD (10), it will be understood that the elastomeric stripper element (18), the lower seal (37) and the outer housing (22) of the RFCD (10) cooperate to provide an additional pressure-resistant barrier between the wellbore fluid and the external environment preventing any such external venting or spillage through the cap (36). The components of the RFCD (10) may be designed and constructed of materials suitable to withstand a desired level of wellbore fluid pressure.

Figure 3:
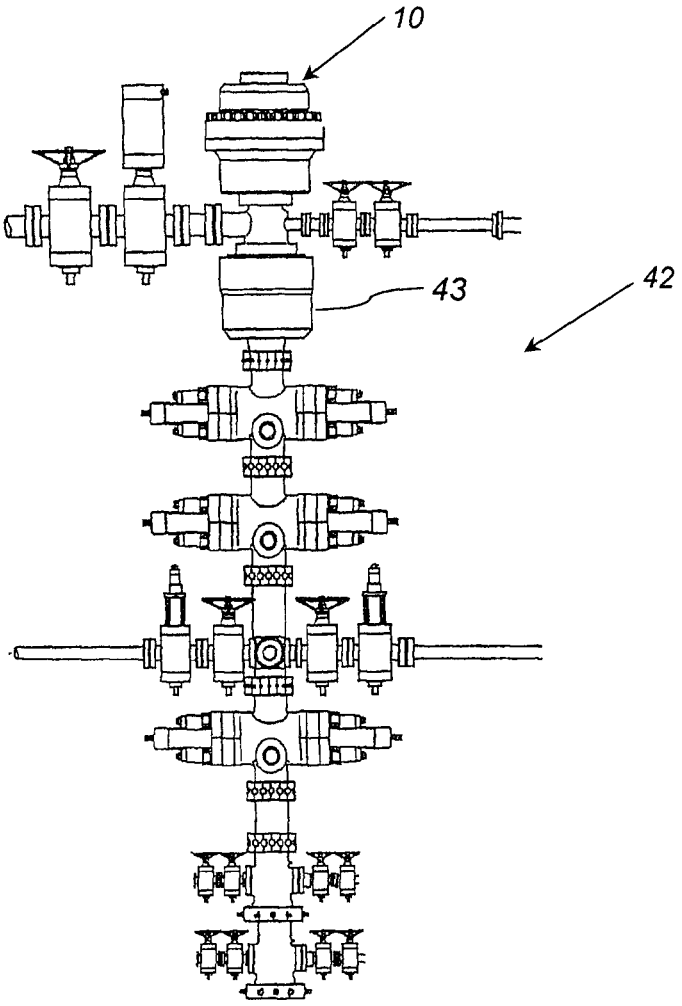
FIG. 3 is a diagrammatic depiction in elevation of one embodiment of the RFCD of the present invention mounted on a blowout preventer stacks annular.

FIG. 3 depicts one embodiment of the RFCD (10) of the present invention mounted on the head of a blowout preventer stacks annular (42). As is known in the art, the blowout preventer (43) defines a central bore for receiving a drill string (not shown) passing therethrough, and comprises an annular sealing element that may be mechanically actuated to seal against the drill string and thereby prevent the upward flow of wellbore returns. The blowout preventer stacks annular (42) may also comprise a series of rams and valves that can be actuated to prevent the upward flow of wellbore fluids. It will be understood that the bore (28) of the stationary housing (14) of the RFCD (10) and the bore of blowout preventer stacks annular (42) are axially aligned to form a contiguous passage for the drill string. Also, it will be understood that the elastomeric stripper element (18), the lower seal (37) and the outer housing (22) of the RFCD (10) cooperate to provide an additional pressure-resistant barrier between the wellbore fluid and the external environment in the event that the blowout preventer (43) or the rams and valves fail to adequately do so.

The RFCD (10) of the present invention may be used for well control operations, to promote rig safety, to address environmental concerns, for underbalanced drilling operations, for managed pressure drilling operations and for conventional drilling operations. As described above, it may be employed in both off-shore and land based drilling operations.

As will be apparent to those skilled in the art, various modifications, adaptations and variations of the foregoing specific disclosure can be made without departing from the scope of the invention claimed herein.

What is claimed is:

1. A system comprising:

a wellbore fluid control device including a first stripper element which can constrict inward relative to a housing of the wellbore fluid control device;

a rotating flow control device including an outer housing, a rotatable inner tubular shaft, and at least one second stripper element that rotates with the rotatable inner tubular shaft relative to the outer housing and independent of the first stripper element; and the system being free of any exterior opening that provides fluid communication with a central bore between the first and second stripper elements.

2. The system of claim 1, wherein a flange connection connects the outer housing directly to the wellbore fluid control device.

3. The system of claim 2, wherein the flange connection is releasably attached to a head of the wellbore fluid control device.

4. The system of claim 2, wherein a stationary housing of the rotating flow control device substitutes for a cap of the wellbore fluid control device.

5. The system of claim 4, wherein a clamp secures the outer housing relative to the flange connection.

6. The system of claim 5, wherein the clamp is manually actuated.

7. The system of claim 5, wherein the clamp is hydraulically actuated.

8. A method comprising:

releasably securing a rotating flow control device above a wellbore fluid control device including a first stripper element, the rotating flow control device including an outer housing, a rotatable inner tubular shaft, and at least one second stripper element that rotates with the rotatable inner tubular shaft relative to the outer housing and independent of the first stripper element;

constricting the first stripper element inward; and flowing wellbore fluid outward via an exterior port while the first stripper element is constricted inward, the first stripper element being disposed between the exterior port and the second stripper element.

9. The method of claim 8, wherein the wellbore fluid control device comprises a riser diverter.

10. The method of claim 8, wherein the wellbore fluid control device comprises an annular preventer of a blowout preventer stack.

11. A system, comprising:

a wellbore fluid control device including a first stripper element that selectively restricts flow of wellbore fluid through a central bore of the wellbore fluid control device, and an exterior port that provides fluid communication with the wellbore fluid control device central bore; and a rotating flow control device including an outer housing, a rotatable inner tubular shaft, and a second stripper element that restricts the flow of the wellbore fluid through a central bore of the rotating flow control device, the rotating flow control device being releasably secured to the wellbore fluid control device, wherein the second stripper element rotates with the rotatable inner tubular shaft relative to the outer housing and independent of the first stripper element, and wherein the wellbore fluid is prevented from flowing outward from an annular space axially between the first and second stripper elements.

12. The system of claim 11, in which fluid communication is prevented between an external environment and the central bores of the wellbore fluid control device and the rotating flow control device between the first and second stripper elements.

13. The system of claim 11, in which the system is free of any exterior opening that provides fluid communication with the central bores of the wellbore fluid control device and the rotating flow control device between the first and second stripper elements.

14. The system of claim 11, in which a flange connection connects the rotating flow control device to the wellbore fluid control device.

15. The system of claim 14, in which the flange connection is releasably attached to a head of the wellbore fluid control device.

16. The system of claim 14, in which a stationary housing of the rotating flow control device substitutes for a cap of the wellbore fluid control device.

17. The system of claim 14, in which a clamp secures the rotating flow control device relative to the flange connection.

18. The system of claim 11, in which the wellbore fluid control device comprises a riser diverter.

19. The system of claim 11, in which the wellbore fluid control device comprises an annular preventer of a blowout preventer stack.

* * * * *